US005720648A

United States Patent [19]

Green et al.

[11] Patent Number: 5,720,648

[45] Date of Patent: Feb. 24, 1998

[54] FEED RATE CONTROLLER FOR THICKNESS SANDING MACHINE

[76] Inventors: Gary L. Green, 17060 Judicial Rd., Lakeville, Minn. 55044; Peter Pemrick, 9251 Kiowa Trail, Chanhassen, Minn. 55317; Theodore F. Nash, 5536 Glenavon Ave., Minnetonka, Minn. 55345

[21] Appl. No.: 510,973

[22] Filed: Aug. 3, 1995

[51] Int. Cl.[6] ..... B24B 49/00; B24B 51/00

[52] U.S. Cl. ..... 451/8; 451/178; 451/340; 451/396

[58] Field of Search ..... 451/340, 496, 451/360, 363, 541, 499, 241, 178, 300, 296, 24, 26, 295, 358, 5, 8

[56] References Cited

U.S. PATENT DOCUMENTS

| | | | |
|---|---|---|---|
| 2,467,978 | 4/1949 | Kerr et al. | 451/340 |
| 3,455,066 | 7/1969 | Estabrook | 451/300 |
| 3,608,245 | 9/1971 | Fair, Jr. et al. | 451/300 |
| 3,877,180 | 4/1975 | Brecker | 451/295 |
| 4,346,536 | 8/1982 | Bryden | 451/360 |
| 4,558,538 | 12/1985 | Green | 451/178 |
| 4,628,641 | 12/1986 | Lazzari | 451/360 |
| 4,642,943 | 2/1987 | Taylor, Jr. | 451/296 |
| 4,720,940 | 1/1988 | Green | 451/340 |
| 5,180,347 | 1/1993 | Chen | 482/5 |
| 5,181,347 | 1/1993 | Green | 451/499 |
| 5,184,424 | 2/1993 | Miller | 451/300 |
| 5,185,962 | 2/1993 | Liou | 451/296 |
| 5,421,126 | 6/1995 | Strege | 451/296 |

*Primary Examiner*—James G. Smith
*Assistant Examiner*—Derris H. Banks
*Attorney, Agent, or Firm*—Merchant, Gould, Smith, Edell, Welter & Schmidt, P.A.

[57] ABSTRACT

A drum sanding machine having a vertically-adjustable sanding drum mounted over a conveyor, where the sanding drum is direct-coupled to an AC drive motor. The conveyor includes an endless loop belt connected to a variable speed DC motor, and a feedback circuit is connected to monitor the AC drive motor current and to develop a feedback signal to slow the DC motor when the AC motor drive current exceeds a predetermined value.

12 Claims, 3 Drawing Sheets

FEED RATE CONTROLLER FOR THICKNESS SANDING MACHINE

BACKGROUND OF THE INVENTION

This invention relates to sanding machines and conveyors associated therewith; more particularly, the invention relates to an apparatus for controlling the rate of speed of a sanding machine conveyor in response to loading conditions of the sanding machine motor.

The invention finds particular utility in respect to thickness sanding machines which may utilize either a drum or wide belt for applying an abrasive against a workpiece. Typical sanding machines which may be used in conjunction with the present invention are illustrated in U.S. Pat. Nos. 4,720,940 and 5,180,347, by the inventor of the present invention.

A characteristic of a wide belt or drum sanding machine is that either of them apply a moving abrasive surface against a workpiece which is itself moved relative to the belt or drum. The abrasive sanding surface is typically vertically adjustable to accommodate different thicknesses of workpiece and also to permit the operator to control the amount of force applied against the workpiece surface by the sanding drum or belt. It is important that the workpiece be moved smoothly past the rotating sanding drum or moving sanding belt in order to ensure a smooth surface on the workpiece after the operation has been completed. It is also important that the moving abrasive surface of the sanding drum or belt not be engaged too forcefully against the workpiece, for this can overload the drive motor and damage the workpiece.

Movable conveyors are used in conjunction with sanding drum machines to provide a smooth and continuously moving support surface for the workpiece as it passes beneath the abrasive drum. This facilitates the sanding operation and provides a uniform surface on the workpiece after the operation has been completed. It is typical that the speed of the conveyor may be adjustable by the operator depending upon the thickness and composition of the workpiece, the amount of surface material being removed by the sanding machine, and other factors. If the workpiece has irregular, surface thicknesses, it is important that the conveying speed be adjustable so that the rate of travel of the workpiece past the sanding drum may be slowed when the sanding drum encounters areas of heavier thickness. This will enable the sanding drum to remove the thicker surface irregularities without unduly overloading the sanding drum drive motor.

It would be useful to provide a conveyor having an automatic speed controller such that the workpiece conveying speed could be slowed automatically whenever irregular thicknesses on the workpiece were encountered by the sanding drum.

SUMMARY OF THE INVENTION

The present invention provides for automatic feed rate control of a conveyor past a sanding drum which overrides a manual feed rate control associated with the conveyor. The sanding drum is mechanically rotated by an AC drive motor wherein the drive motor shaft is directly coupled to the drum. The sanding drum is vertically adjustable over a work table, and a conveyor belt is positioned over the work table for conveying workpiece articles past the sanding drum. The conveyor is driven by a DC motor which has a manually adjustable speed rate control associated therewith. The DC motor is connected to a source of power via a DC motor controller, and the DC motor controller has a feedback connection from a current sensor placed in the current supply line to the drum AC drive motor, such that increased drive current to the drum motor causes a negative feedback signal to be supplied to the DC motor controller, thereby slowing the DC motor rotational rate and consequently slowing the feed rate of the conveyor.

It is a principal object of the present invention to provide a conveyor feed rate controller which automatically compensates for loading effects on a drum drive motor.

It is another object of the present invention to provide a conveyor feed rate controller for a sanding drum machine which may be manually set to a predetermined conveyor speed and which conveyor speed is downwardly adjustable under loading conditions.

BRIEF DESCRIPTION OF THE DRAWINGS

The foregoing and other objects and advantages of the invention will become apparent from the following specification and claims and with reference to the appended drawings.

DESCRIPTION OF THE PREFERRED EMBODIMENT

Figure 1:
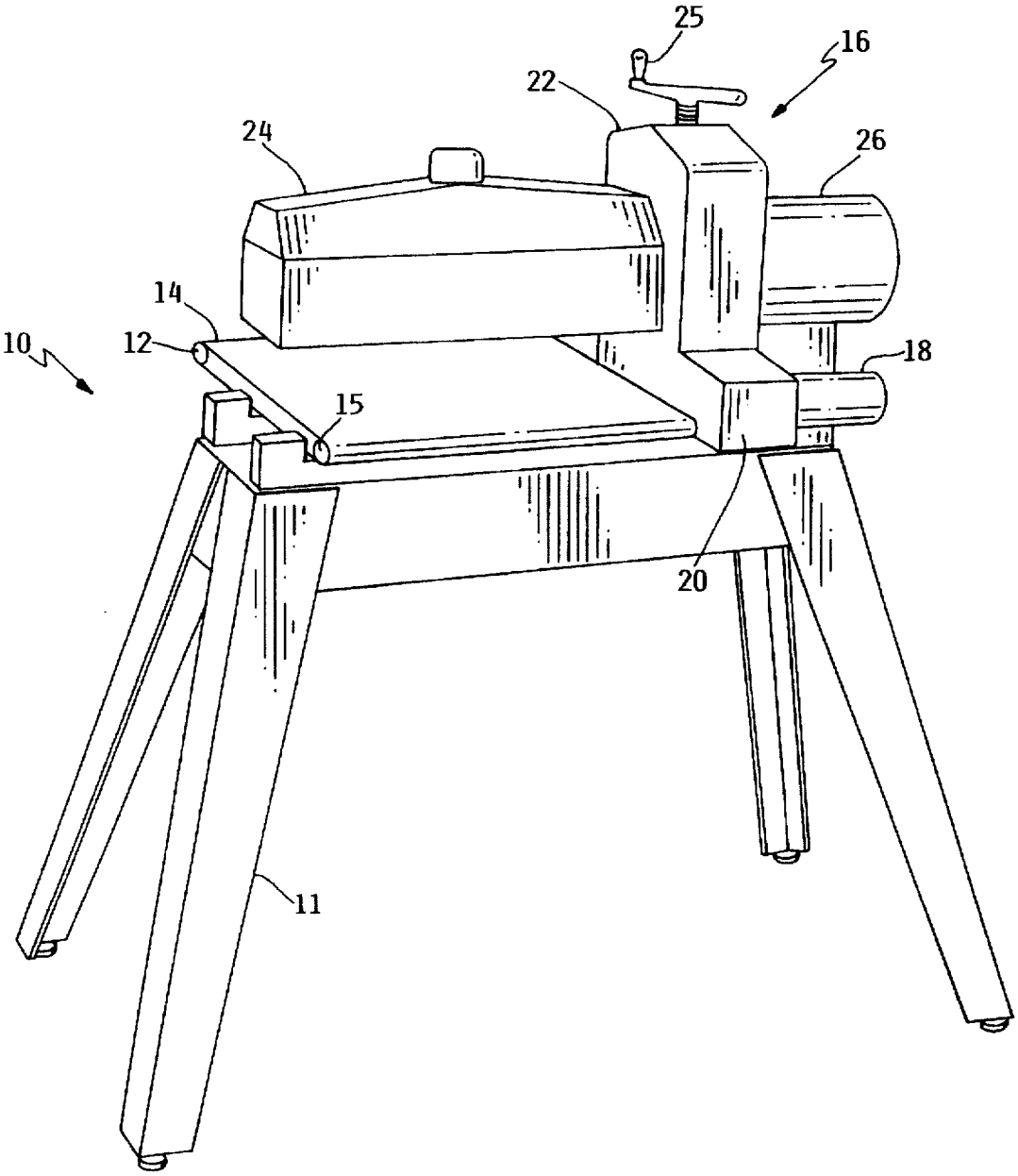
FIG. 1 shows an isometric view of a drum sanding machine and conveyor incorporating the present invention.

Referring first to FIG. 1 there is shown a sanding machine 10 which includes a stand 11 for supporting a conveyor 14 and a drum sander 16. Conveyor 14 consists of an endless belt which passes over a table surface and is connected about two rotatable end shafts 12 and 15. End shaft 15 is mechanically linked via a gear box and controller 20 to a DC motor 18. The sander 16 is supported by a mounting yoke assembly 22 in which a vertically-adjustable housing 24 may be positioned by rotating a handle 25 which is connected to a screw drive 27. An AC drive motor 26 is mechanically coupled to a sanding drum which is housed within housing 24.

Figure 2:
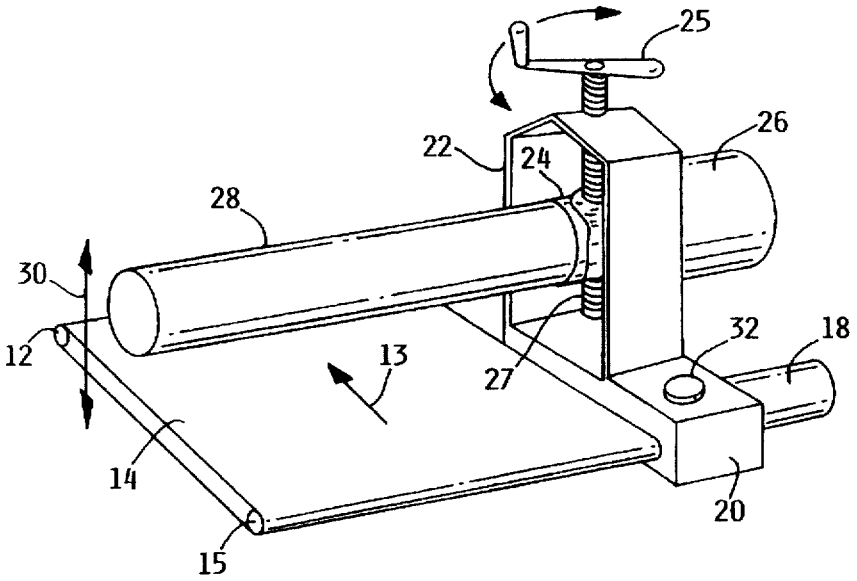
FIG. 2 shows a diagram of a portion of the machine of FIG. 1.

Referring next to FIG. 2, a portion of the sanding machine of FIG. 1 is illustrated in diagrammatic form. The AC drive motor 26 and sanding drum 28 are vertically adjustable as illustrated by arrow 30 by rotating handle 25 in either a clockwise or counterclockwise direction. Handle 25 is connected to a threaded screw 27 which passes through a threaded opening in the sanding drum/motor housing 24.

Conveyor 14 is movable in the direction illustrated by arrow 13 as an endless loop conveyor belt. The surface of conveyor 14 is preferably made from an abrasive material to better grip a workpiece as it is moved along its path of travel. One end of the conveyor 14 is looped about a shaft 15 which is mechanically coupled to a gear box 20 and to a DC drive motor 18. Gear box 20 also includes the electronic control circuitry associated with the invention, including an adjustment knob 32 which the operator may position so as to adjust the conveying speed of conveyor belt 14.

Figure 3:
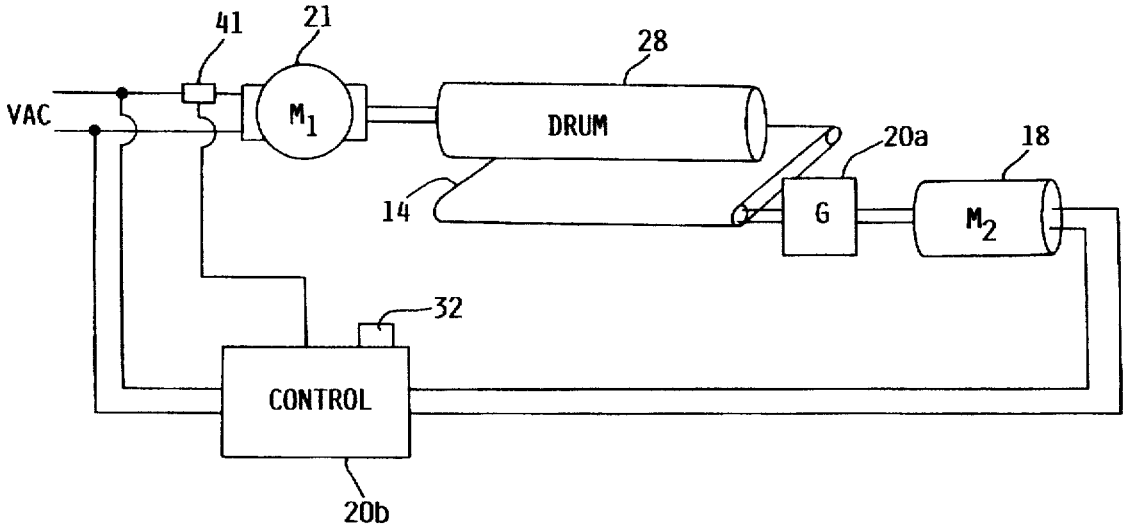
FIG. 3 shows an illustrative schematic diagram of the electrical controls associated with the present invention.

FIG. 3 shows a pictorial schematic representation of the electrical and mechanical circuits of the present invention. AC motor $M_1$, referred to as element 21, is a one-to-five horsepower motor having about a 20 amp full load current rating. AC motor 21 is mechanically coupled to drum 28 and causes drum 28 to rotate at approximately 1,700 revolutions per minute (rpm). Conveyor 14 is preferably formed of a conveyor belt material having an abrasive surface, preferably about 120 grit. Conveyor 14 is driven by DC motor $M_2$, designated as element 18, via a gear box G, designated as element 20*a*. Conveyor motor 18 is about a 1/30 horsepower DC motor having about 50 in./lb. torque, which will drive the conveyor 14 at a linear belt rate of 0–10 feet per minute. The electrical power for driving motor 18 is derived from a controller 20*b* which converts an alternating current input voltage to a direct current voltage.

Figure 4:
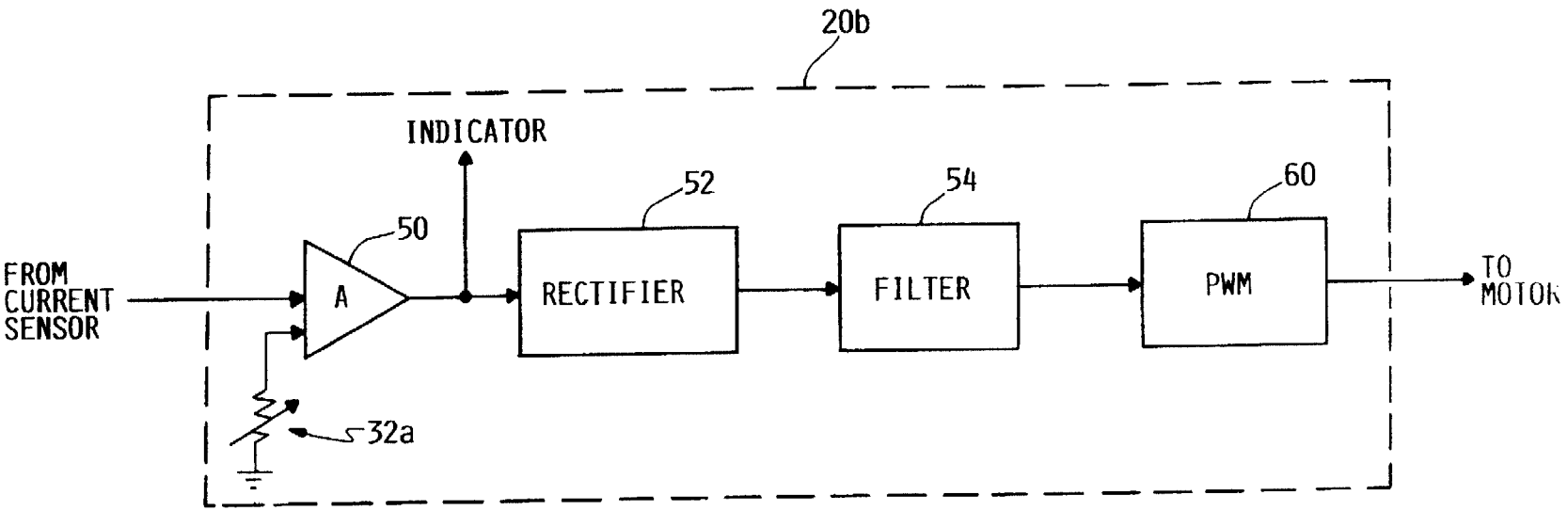
FIG. 4 shows an illustrative schematic diagram of the electrical controls associated with the present invention.

Current sensor 41 may take many forms within the skill of the art; one form which is preferred for use with the present invention is a toroidal transformer, wherein a secondary coil is wound around a ferrite toroid and the AC current line to the motor 21 passes through the center of the toroid. The secondary coil output voltage is typically about 50 millivolts (mv) and is coupled to an amplifier 50 in controller 20*b* as shown in FIG. 4. Conveyor speed adjustment knob 32 may be connected to a variable resistance circuit 32*a*, which is connected as a gain adjustment circuit to amplifier 50. Alternatively, the conveyor speed adjustment knob may be connected to a gating circuit as an input to pulse width modulator 60, to control the duty cycle of the modulator 60 and, therefore, the output DC voltage. The amplified signal from amplifier 50 is about 5 volts, and this signal is connected to a full wave rectifier 52 and then to a filter 54. The filtered output signal from filter 54 is connected as an input to pulse width modulator 60, which preferably operates at a frequency of about 22 kilohertz (Khz). The output signal from pulse width modulator 60 is a chopped DC voltage which is connected to DC motor 18.

In operation, the AC drive motor connected to the drum rotates at a constant rotational speed; but as a material is conveyed past the drum surface, the AC motor drive current may increase in response to increasing load effects against the drum surface. The operator manually adjusts the clearance between the rotating drum and the moving conveyor, and manually adjusts the conveyor speed. The operator then places a workpiece on the conveyor to enable it to pass beneath the sanding drum, where the surface of the workpiece is sanded by the abrasive covering over the drum. If too little clearance is selected by the operator, the drum will become loaded down; and the current to the drum motor will increase dramatically. As the AC motor drive current increases, the current sensor generates a control voltage to the controller 20*b* which will slow the conveyor rate of travel thereby slowing the workpiece as it passes beneath the drum. In the extreme, the conveyor will slow to a complete stop if the clearance is too low to permit the sanding drum to continue rotating within the power limits of the AC drive motor. In the preferred embodiment, the circuits associated with controller 20*b* are designed to impose no speed restraint on the conveyor motor until the AC drive motor current reaches about one-half of its full load rated current. At approximately ½ the full load current rating of the AC drive motor the current sensor signal begins regulating the DC motor speed, slowing the speed from the manually-selected value set by the operator's adjustment of speed adjustment knob 32. Thereafter, with increasing AC drive motor current the DC motor is slowed linearly until the AC drive motor current reaches its full rated value, whereupon the DC motor driving the conveyor is stopped completely. It is contemplated that a light indicator may be provided to indicate the point at which DC motor speed regulation begins to alert the operator that it may be necessary to further adjust the clearance between the sanding drum and the conveyor to lighten the loading effect against the sanding drum.

The foregoing description of the preferred embodiment of the invention may be modified within the scope of the invention, it being desired that the scope of the invention be limited to the following claims. For example, other variations to the design of the controller of the present invention may be made to achieve the desired regulation of the conveyor drive speed in response to loading effects on the drum drive motor. Of course, a wide belt sander may be substituted for the sanding drum; and the advantageous features of the invention may still be realized to regulate the speed of a conveyor for moving a workpiece past the wide belt sanding surface.

What is claimed is:

1. A sanding machine for regulating the loading effects of a workpiece passing beneath a moving sanding surface, comprising:

a) a conveyor mounted to a table surface, for conveying a workpiece along a linear path of travel;

b) a movable sanding surface positioned above said conveyor, said sanding surface being movable by connection to an AC drive motor;

c) means for vertically adjusting the position of said sanding surface and said AC drive motor above said conveyor;

d) a DC motor connected to said conveyor, said DC motor having a controller associated therewith for selectively adjusting the rate of travel of said conveyor;

e) a current sensor having means for sensing the drive current to said AC drive motor, to develop an output signal representative of said drive current; and f) a feedback circuit connected to said current sensor and to said DC motor controller, said feedback circuit developing a signal to said controller to cause said controller to slow the rate of travel of said conveyor in response to said current sensor output signal.

2. The machine of claim 1, wherein said movable sanding surface further comprises a drum having an abrasive material substantially covering the external surface of said drum.

3. The machine of claim 2, wherein said conveyor further comprises an endless loop belt mounted between a drive roller and an idler roller, said belt having a center portion movable over said table.

4. The machine of claim 3, wherein said belt further comprises an abrasive exterior surface.

5. The machine of claim 4, wherein said controller further comprises an amplifier having a manually-selectable gain control, and a pulse width modulator connected to said DC motor.

6. The machine of claim 5, wherein said feedback circuit further comprises means for slowing said DC motor when said AC drive current reaches approximately ½ its full rated load value.

7. The machine of claim 6, wherein said feedback circuit further comprises means for slowing said DC motor to a stopped condition when said AC drive current reaches its full rated load value.

8. A drum sanding machine mounted to a table and having load regulating capabilities, comprising:

a) a rotatable sanding drum and direct coupled AC drive motor mounted above said table, and means for vertically positioning said sanding drum;

b) a conveyor comprising an endless loop belt mounted to said table beneath said sanding drum, and a variable speed DC drive motor coupled to move said endless loop belt over said table;

c) a controller circuit having a manually adjustable speed control, connected to drive said DC motor; and d) a feedback circuit connected between said AC drive motor and said controller circuit, said feedback circuit having means for monitoring the current to said AC drive motor and means for developing a signal to said controller circuit to cause said controller circuit to decrease the speed of said DC drive motor; whereby said conveyor is slowed when said AC drive current exceeds a predetermined value.

9. The machine of claim 8, wherein said predetermined value is approximately ½ the full rated drive current of said AC drive motor.

10. The machine of claim 9, wherein said controller further comprises means for reducing the conveyor speed to zero, in response to said feedback circuit, when the AC drive motor current reaches its full rated drive current value.

11. The machine of claim 10, wherein said conveyor endless loop belt further comprises a belt having an abrasive surface coating on at least one surface.

12. The machine of claim 11, wherein said controller circuit further comprises a pulse width modulator connected to said DC motor.

* * * * *